US006454192B2

(12) United States Patent
Perry

(10) Patent No.: US 6,454,192 B2
(45) Date of Patent: Sep. 24, 2002

(54) ENGINE FUEL INJECTOR WITH ASSEMBLED MAGNETIC COIL BODY

(75) Inventor: Robert B. Perry, Leicester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/765,066

(22) Filed: Jan. 18, 2001

Related U.S. Application Data

(60) Provisional application No. 60/176,976, filed on Jan. 19, 2000.

(51) Int. Cl.[7] ..... B05B 1/30; F02M 51/00

(52) U.S. Cl. ..... 239/585.1; 239/585.3; 239/585.4; 239/585.5

(58) Field of Search ..... 239/585.1, 585.3, 239/585.4, 585.5, 1, 533.2, 533.9, 533.14; 251/129.21, 129.16, 127, 318, 129.15

(56) References Cited

U.S. PATENT DOCUMENTS 5,577,663 A * 11/1996 Nally et al. ..... 239/1
5,950,932 A * 9/1999 Takeda et al. ..... 251/585.4
5,975,436 A * 11/1999 Reiter et al. ..... 239/585.1
5,979,866 A * 11/1999 Baxter et al. ..... 251/129.21
6,012,655 A * 1/2000 Maier ..... 239/585.4
6,173,915 B1 * 1/2001 Cohen et al. ..... 239/585.1
6,168,098 B1 * 2/2001 Brinn, Jr. ..... 239/585.4

* cited by examiner

*Primary Examiner*—Lesley D. Morris
*Assistant Examiner*—Davis Hwu
(74) *Attorney, Agent, or Firm*—Patrick M. Griffin

(57) ABSTRACT

An injector coil body assembly with upper and lower coil bodies is held together with a spring type press fit instead of welding. The coil bodies are made with generally tubular connecting portions telescoped together around the magnetic coil. The downwardly open tubular lower portion of the upper body is longer and slightly smaller than the connecting upwardly open tubular upper portion of the lower body so that the lower portion of the upper body fits into the upper portion of the lower body. A longitudinal slot in the upper body lower portion allows the lower portion to spring in slightly upon insertion into the lower body upper portion so that the upper and lower bodies are retained in assembly by a spring biased press fit. The press fit holds the telescoped portions in close contact, providing an efficient path for carrying the magnetic flux of the coil.

5 Claims, 2 Drawing Sheets

ENGINE FUEL INJECTOR WITH ASSEMBLED MAGNETIC COIL BODY

CROSS REFERENCE TO RELATED APPLICATIONS

This application claims the benefit of U.S. provisional patent application No. 60,176,976 filed Jan. 19, 2000.

TECHNICAL FIELD

This invention relates to engine fuel injectors and, more particularly, to a solenoid actuated fuel injector having a magnetic coil body with upper and lower members assembled with an unwelded telescoped joint.

BACKGROUND OF THE INVENTION

It is well known in the automotive engine art to provide solenoid actuated fuel injectors for controlling the injection of fuel into the cylinders of spark ignition engines, generally through intake manifold runners or intake ports of the cylinders. Generally, such injectors include a body having added internal and external components which are assembled and welded, brazed or otherwise sealed together to provide internal fuel passages for conducting fuel flow. Fuel flow is controlled by a solenoid valve having an orificed valve seat controlled by an armature with a valve element, spring biased toward the seat for closing the valve. A solenoid coil surrounds a magnetic inner pole to which the armature is drawn when the coil is energized to open the valve.

For efficient operation, a magnetic coil body is provided that generally surrounds the coil and provides a magnetic circuit or flux path extending from the magnetic pole around the outside of the coil to the armature and, through the armature, back to the coil. A gap provided in the flux path between the armature and the pole is closed when the armature is drawn to the pole to open the valve. A second gap is provided between the armature and the coil body to allow free motion of the armature. Other gaps in the magnetic flux path are controlled or avoided as they decrease magnetic force on the armature so that a larger coil using greater energy may be required.

The coil body is commonly made in two sections, such as upper and lower coil bodies, which are assembled around the coil and welded together to close the gap in the magnetic flux path. However, this requires assembly steps and equipment which add to the complexity and cost of the assembly process.

SUMMARY OF THE INVENTION

The present invention provides an injector having a coil body assembly with modified upper and lower coil body components that are designed to be assembled and held together with a spring type press fit instead of by welding. The components are made with generally tubular end portions that are telescoped together in assembly to provide an enlarged central portion that surrounds the magnetic coil. The downwardly open tubular portion of the upper body is longer and slightly smaller than the upwardly open tubular portion of the lower body, so that the upper portion may be fitted into the lower portion. A longitudinal slot is provided in the upper portion for protrusion of insulated coil terminals. The slot also allows the upper portion to spring in slightly upon insertion into the lower portion. Thus the upper and lower body are retained in assembly by a spring biased press fit of the components. The press fit holds the telescoped portions of the assembly in close contact, providing good path for carrying the magnetic flux of the coil. Welding of the components together is accordingly not required and manufacture is simplified.

These and other features and advantages of the invention will be more fully understood from the following description of certain specific embodiments of the invention taken together with the accompanying drawings.

DESCRIPTION OF THE PREFERRED EMBODIMENT

Figure 1:
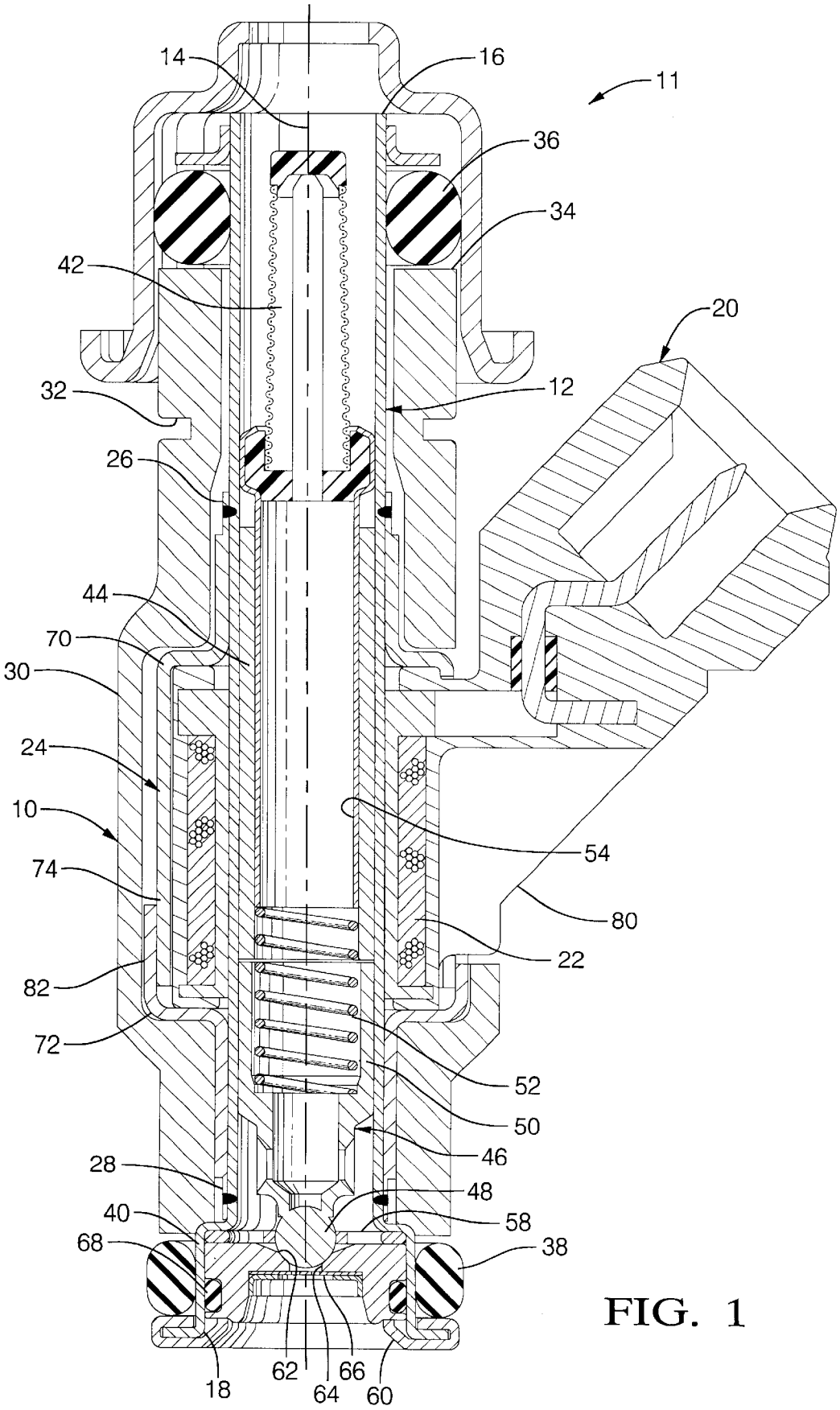
FIG. 1 is a cross-sectional view of an engine fuel injector having a non welded coil body assembly according to the invention.

Referring first to FIG. 1 of the drawings in detail, numeral 10 generally indicates a solenoid actuated fuel injector according to the present invention shown as mounted in an engine 11. Injector 10 includes a continuous endoskeletal nonmagnetic injector tube 12, which is centered on a central axis 14 and encloses a continuous passage 15 through the injector from an inlet end 16 of the tube to an outlet end 18. Preferably, the tube 12 has no openings except at the inlet and outlet ends and defines a continuous imperforate passage in which fuel is conducted and kept separate from all the components of the injector that are mounted externally of the tube. These include a separately formed coil assembly 20 including a solenoid coil 22 extending around and closely adjacent to the tube but isolated thereby from the fuel in the tube. A magnetic coil body assembly 24 surrounds the coil 22 and has upper and lower ends 26, 28 fixed to the outer surface of the tube 12.

An overmolded or assembled cover 30 is disposed around the tube and engages the body assembly 24. The cover includes a slot 32 for receiving a retainer clip, not shown, that holds the injector inlet end within a cup 34, of an associated fuel rail, not shown. The cover also provides a backup surface at one end for constraining a seal ring 36 of the conventional O-ring type. The cover extends around the lower end of the body assembly 24 and partially defines a groove for an annular seal ring 38 retained on an expanded diameter portion 40 at the lower end of the injector tube 12.

Within the injector tube 12, an inlet fuel filter 42 is provided at the inlet end of the tube. A tubular magnetic pole 44 is fixed within the tube in engagement with its interior surface. The pole extends from adjacent the upper end 26 of the body assembly 24 to a position within the axial extent of the coil 22. An injection valve 46 is reciprocable within the tube 12 and includes a ball end 48 connected with a hollow armature 50 that slides within the tube. A biasing spring 52 engages the armature and a spring adjusting sleeve 54 is fixed within the magnetic pole 44 to urge the injection valve 46 downward toward a closed position.

Within the expanded diameter portion 40 of the tube 12, a valve seat 56 and a lower valve guide 58 are retained by a retainer ring 60 that is crimped over a flange at the tube outlet end 18. The lower valve guide 58 is a disc positioned between the valve seat and a flange-like surface formed by the expanded diameter tube portion 40 to guide the ball end 48 of the injection valve. The disc 58 includes openings to allow fuel flow through the valve guide 58 to a conical surface 62 of the valve seat against which the ball end 48 seats in the valve closed position. A central discharge opening 64 of the valve seat 56 connects the conical surface 62 with a multi-hole spray director 66 retained in the valve seat. An outer seal ring 68 is captured in a groove of the valve seat 56 and prevents fuel from leaking around the valve seat and bypassing the discharge opening 64.

Figure 2:
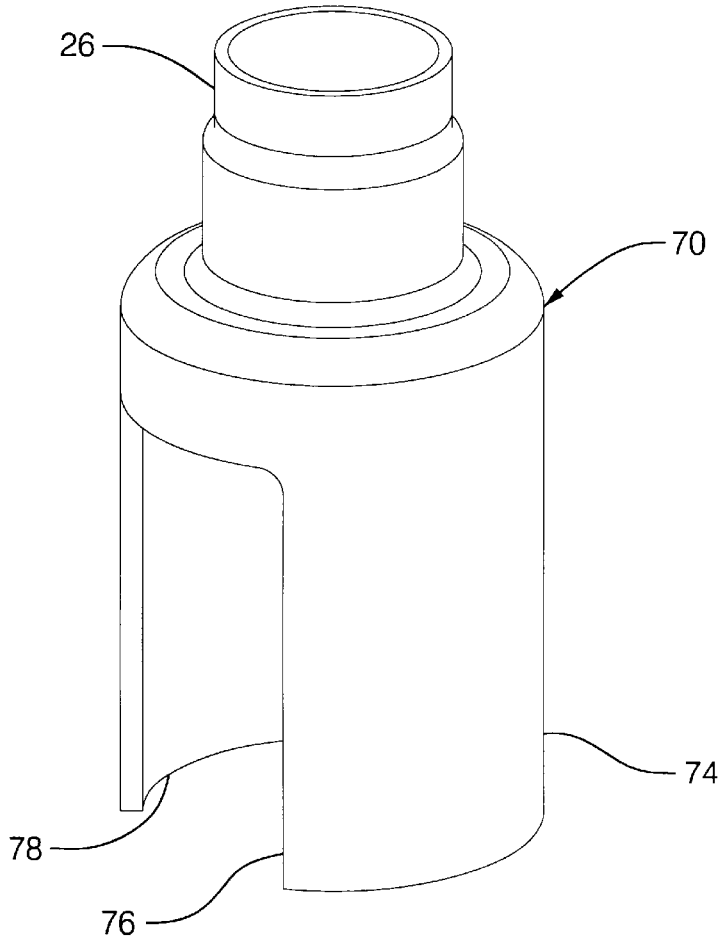
FIG. 2 is a pictorial view of the upper coil body of the injector of FIG. 1.

In accordance with the invention, the coil body assembly 24 includes an upper body 70 and a lower body 72. The upper body 70, shown in FIG. 2, includes the coil body assembly upper end 26, of tubular form and sized for attachment to the injector tube 12, such as by welding above the end of the magnetic pole 44. A lower portion 74 of the upper body 70 is enlarged to fit closely around and preferably along the total length of the coil assembly 20. The lower portion 74 is also tubular but includes a wide longitudinal slot 76 extending from an open lower end 78 upward to near the upper end 26. In assembly, the slot 76 fits over insulated coil terminals 80 that protrude from one side of the coil assembly 20.

Figure 3:
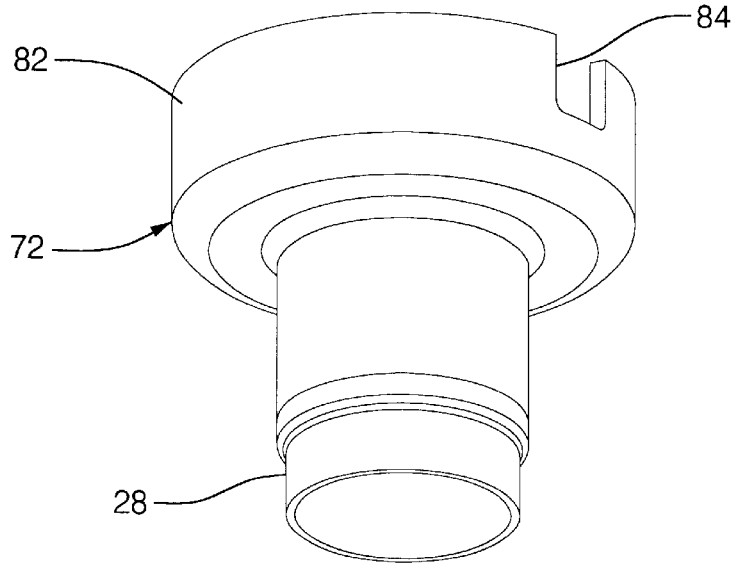
FIG. 3 is pictorial view of the lower coil body of the injector of FIG. 1.

The lower body 72, shown in FIG. 3, includes the coil body assembly lower end 28, having tubular form and sized for attachment to the injector tube 12, such as by welding below the coil assembly 20. An upper portion 82 of the lower body 72 is enlarged to fit closely around the lower portion 74 of the upper body, extending upward for a length sufficient to provide a good magnetic flux path through the connected portions 74, 82. A small slot 84 is formed in the upper portion 82 to accommodate a lower edge of the coil terminals 80.

In assembly of the injector 10, the lower body 72 and coil assembly 20 are first fitted onto the injector tube 12. The upper body 70 is then fitted onto the tube 12 and the lower portion 74 is inserted or telescoped into the upper portion 82 of the lower body 62. The slotted wall of the upper portion 82 may spring inward slightly to accommodate its entry into the lower portion 74 where it is retained temporarily by a spring press fit. The upper and lower bodies 70, 72 form the coil body assembly 24, the upper and lower ends of which may then be welded to the injector tube 12 while the press fitted joint of the telescoped upper and lower bodies 70, 72 completes the magnetic flux path through the body assembly 20 without being welded. The cover 30 may then be molded in place over the fuel tube and coil body assembly or the cover may be assembled from separate components in any suitable manner. Internal portions of the injector within the injector tube 12 may be assembled into the tube either before or after completion of the exterior portions as may be desired or advantageous.

In operation, energizing of the coil 22 creates a magnetic flux which is directed along a flux path through the magnetic pole 44, the coil body assembly 24, the armature 50 and across a gap to the magnetic pole 44. The flux draws the armature 50 upward into engagement with the end of the magnetic pole 44, closing the gap and moving the ball end 48 of valve 46 upward, away from the conical surface 62 of the valve seat 56. Fuel is then allowed to flow through the tube 12 and valve seat 56 and out through the director 66 into an associated intake manifold or inlet port of the associated engine 11. Upon de-energization of the coil 22, the magnetic field collapses and spring 52 seats the valve 46 on conical surface 62, cutting off further fuel injection flow and reopening the gap between the armature 50 and magnetic pole 44.

The non welded telescoped joint of the coil body assembly 24 provides an efficient magnetic flux path through the coil body assembly while reducing complexity and cost in assembly of the injector. The telescoped coil body joint may also be applied as desired to other forms of injectors which may have, for example, injector tubes or fuel tubes that extend only partially through the injector but which utilize a coil body, strap or other form of return flux path around the exterior of an operating solenoid coil.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A fuel injector comprising:

a solenoid coil at least partially surrounding a tubular magnetic pole;

a valve armature attractable to the magnetic pole to open a fuel valve when the coil is energized;

a magnetic flux carrying coil body assembly extending around the coil from adjacent an upper end of the pole to adjacent the armature, the assembly including an upper body and a lower body;

wherein the upper and lower bodies include connecting portions extending along an outer side of the coil and overlapped in frictional engagement with one another for defining a magnetic flux carrying joint between the portions of the bodies.

2. A fuel injector as in claim 1 wherein the connecting portions of the upper and lower bodies are generally tubular and sized such that adjacent ends of the connecting portions are telescoped, one within the other.

3. A fuel injector as in claim 1 wherein the upper and lower bodies are retained in assembly without welding of the connecting portions together.

4. A fuel injector comprising:

a solenoid coil at least partially surrounding a tubular magnetic pole;

a valve armature attractable to the magnetic pole to open a fuel valve when the coil is energized;

a coil body assembly extending around the coil from adjacent an upper end of the pole to adjacent the armature, the assembly including an upper body and a lower body; wherein the upper and lower bodies include connecting portions extending along an outer side of the coil and overlapped in frictional engagement with one another for defining a magnetic flux carrying joint between the portions of the bodies;

the connecting portions of the upper and lower bodies are generally tubular and sized such that adjacent ends of the connecting portions are telescoped, one within the other; and one of the connecting portions includes a slot extending from an open end that allows resilient deflection of the slotted portion during assembly that provides spring fitting of the portions together.

5. A fuel injector as in claim 4, wherein a slotted one of the connecting portions is received in assembly within another of the connecting portions.

* * * * *